United States Patent [19]

Toyota

[11] Patent Number: 4,789,089

[45] Date of Patent: Dec. 6, 1988

[54] AUTOMATIC FASTENER ASSEMBLING MACHINE

[75] Inventor: Sumio Toyota, Toyama, Japan

[73] Assignee: Yoshida Kogyo K. K., Tokyo, Japan

[21] Appl. No.: 72,752

[22] Filed: Jul. 13, 1987

[30] Foreign Application Priority Data

Jul. 16, 1986 [JP] Japan ..... 61-109029[U]

[51] Int. Cl.[4] ..... A41H 37/04

[52] U.S. Cl. ..... 227/15; 227/18

[58] Field of Search ..... 227/15, 18

[56] References Cited

U.S. PATENT DOCUMENTS 3,358,895 12/1967 Chiabrandy ..... 227/15

3,773,237 11/1973 Cruse ..... 227/18

4,615,473 10/1986 Taga ..... 227/15

*Primary Examiner*—Paul A. Bell

*Attorney, Agent, or Firm*—Hill, Van Santen, Steadman & Simpson

[57] ABSTRACT

In an automatic fastener assembling machine, an automatic lower-fastener-element supply apparatus includes a guide member horizontally reciprocable in timed relation to vertical movement of a punch, and a die supported by the guide member and movable, in response to reciprocating movement of the guide member, between a fastener transfer position in which the die is contiguous to the lower end of a chute to receive a lower fastener element therefrom, and a fastener joining position in which the die is vertically aligned with the punch.

6 Claims, 5 Drawing Sheets

AUTOMATIC FASTENER ASSEMBLING MACHINE

This application is related to my copending application, U.S. Ser. No. 072,751.

BACKGROUND OF THE INVENTION

1. Field of the Invention

The present invention relates to an automatic fastener assembling machine, and more particularly to an automatic lower-fastener-element supply apparatus for the machine.

2. Description of the Prior Art

Conventionally, in attaching a garment fastener such as a hook-and-eye fastener to a tubular portion of a garment such as trousers by a fastener assembling machine, it was necessary to thread the tubular portion of the garment onto a die and, for this reason, a lower mating element of the fastener had to be manually placed on the die, which was laborious and time-consuming. Further, this manual placement would cause only inaccurate positioning of the fastener element on the die.

SUMMARY OF THE INVENTION

It is therefore an object of the present invention to provide an automatic fastener assembling machine in which successive lower fastener elements can be automatically supplied, thus causing accurate and efficient positioning of the fastener elements.

Another object of the invention is to provide an automatic fastener assembling machine which facilitates attaching of a fastener to a tubular portion of a garment such as trousers.

According to the present invention, a fastener assembling machine has an automatic lower-fastener-element supply apparatus which comprises: a fastener holding member disposed at the lower open end of a chute for temporarily holding a lower fastener element from the chute; a support block fixed to a frame; a guide member slidably mounted on the support block and operatively connected to a drive means for reciprocating movement in timed relation to vertical movement of a punch and a die supported by the guide member. The die is movable, in response to the reciprocating movement of the guide member, between a fastener transfer position in which the die is contiguous to the holding member to receive the lower fastener element therefrom, and a fastener joining position in which the die is vertically aligned with the punch and is spaced from the support block.

Many other advantages, features and additional objects of the present invention will become manifest to those versed in the art upon making reference to the detailed description and the accompanying sheets of drawings in which a preferred structural embodiment incorporating the principle of the present invention is shown by way of illustrative example.

DETAILED DESCRIPTION

Figure 1:
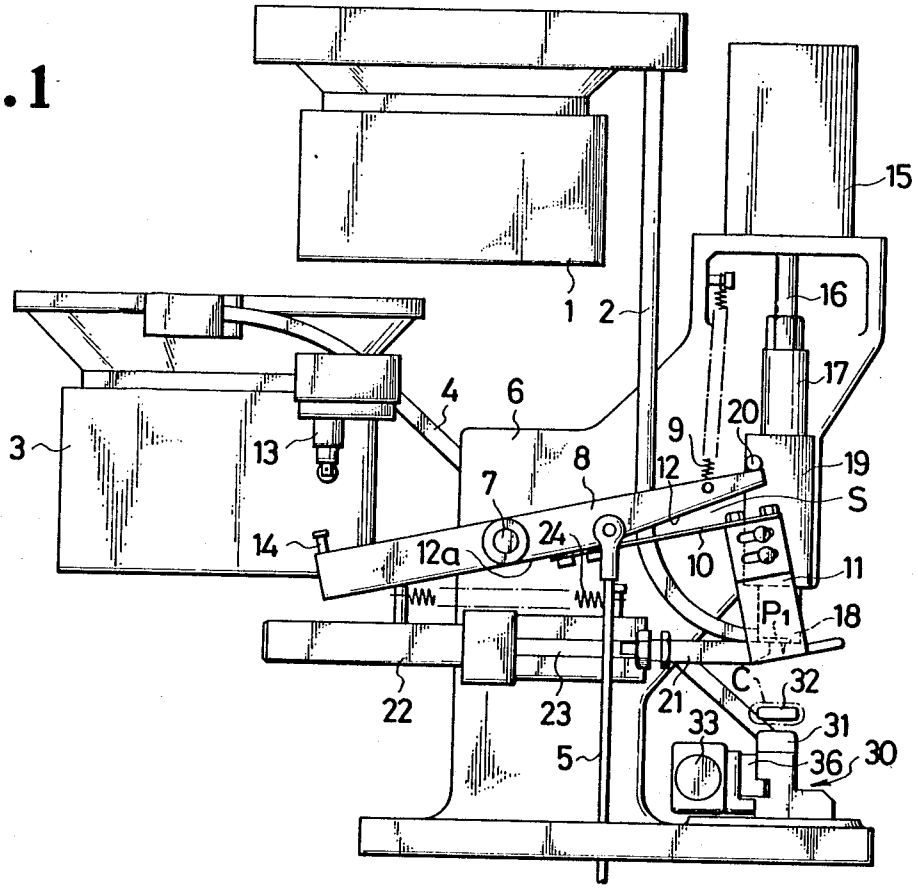
FIG. 1 is a fragmentary front elevational view of an automatic fastener assembling machine embodying the present invention.
Figure 2:
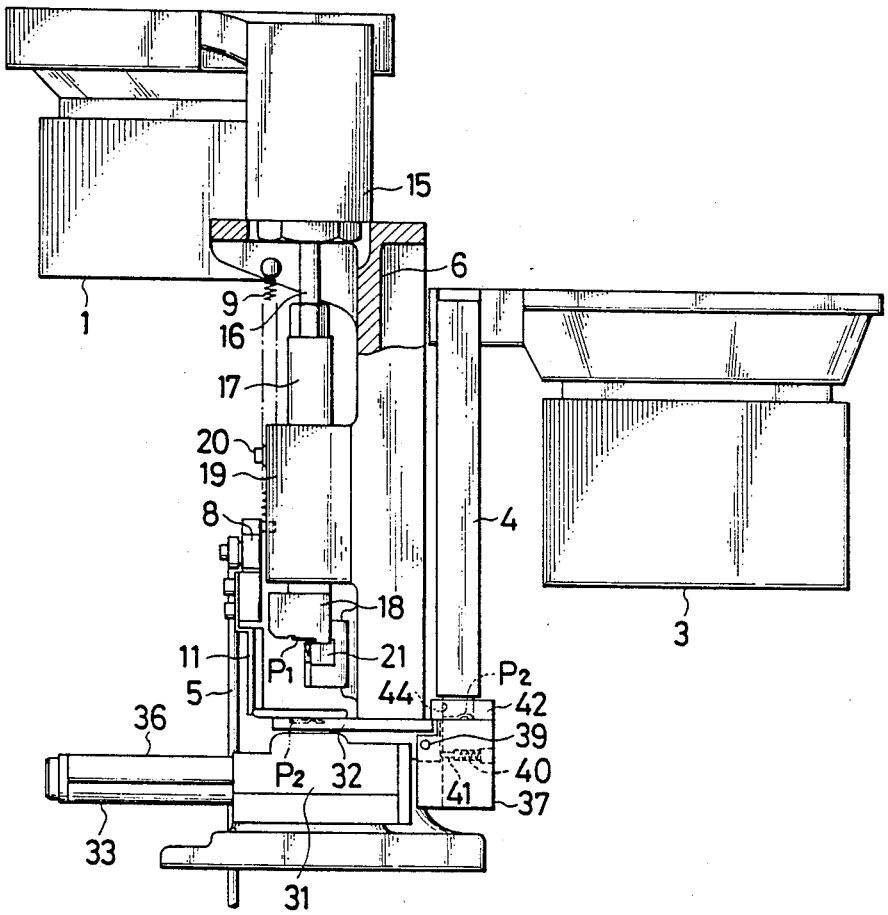
FIG. 2 is a side elevational view, partially in cross section, of FIG. 1, showing a safety cover in lowered position.
Figure 3:
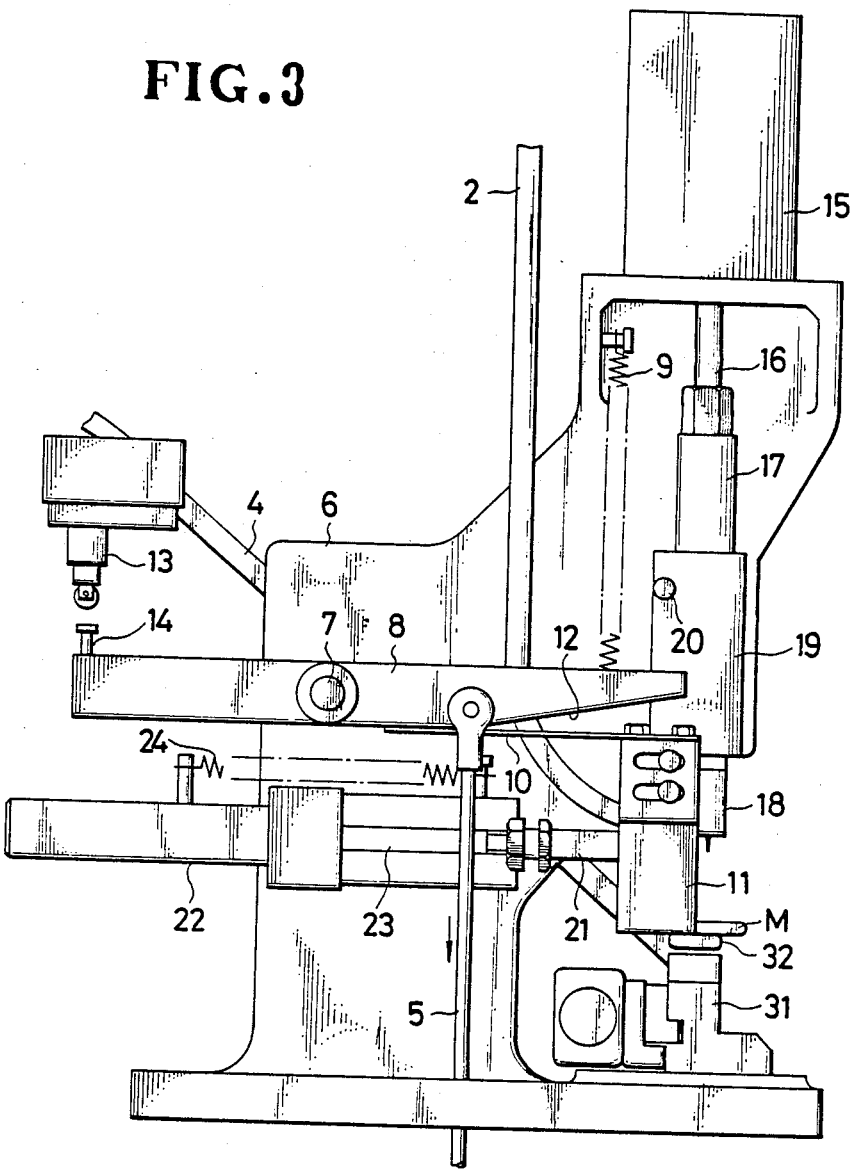
FIG. 3 is a front elevational view of a portion of FIG. 1, showing the safety cover in lowered position.

FIGS. 1 through 3 show an automatic fastener assembling machine for joining a pair of first and second fastener elements P1, P2 together in clenched condition with a garment fabric C sandwiched therebetween. In the illustrated embodiment, the first and second fastener elements P1, P2 comprise a hook and a hasp, respectively. The hasp has at least two apertures, and the hook has at least two spikes projecting from a hook body for piercing through the garment fabric C and also for being inserted through the apertures in the hasp and clenched at the underside of the hasp.

The machine compries an upper or punch unit, a lower or die unit 30, a first chute 2 for feeding successive first fastener elements P1 from a first feeder 1 toward the upper unit, and a second chute 4 for feeding successive second fastener elements P2 from a second feeder 3 toward the lower unit 30.

The machine also has a pusher 21 for supplying the first fastener element P1 from an outlet (lower end) of the first chute 2 to the upper unit. The pusher 21 is connected to a distal end of a piston rod 23 of an air cylinder 22 horizontally slidably supported on a frame 6. An extension spring 24 is mounted between the frame 6 and the air cylinder 22 to normally urge the the latter rightwardly to such a position that a front end of the pusher 21 is normally disposed below the upper unit as the air cylinder 22 is de-energized. When the air cylinder 22 is energized upon actuation of a microswitch 13 (described below) located at a fixed position, the piston rod 23 is shrunk to retract leftwardly from the position of FIG. 1 against the bias of the spring 24 so as not to obstruct the downward movement of the upper unit.

The upper unit includes a guide 19 fixed to the frame 6, a ram 17 vertically reciprocable on the guide 19, and a punch 18 supported on a lower end of the ram 17. The ram 17 is connected at an upper end thereof to a piston rod 16 of an air cylinder 15 fixed to the frame 6. When the air cylinder 15 is energized upon actuation of the microswitch 13 (described below), the piston rod 16 is extended to lower the ram 17 and hence the punch 18.

The machine also has a mechanism for actuating the switch 13. The mechanism includes an actuating lever 8 pivotally mounted on the frame 6 by a pivot 7, and a pull rod 5 connected at its lower end to a foot pedal (not shown) and at its upper end to the actuating lever 8. The connection of the pull rod 5 with the actuating lever 8 is such that when the foot pedal is depressed, the actuating lever 8 is pivotally moved clockwise (FIG. 1) about the pivot 7 against the bias of an extension spring 9. The spring 9 is mounted between the frame 6 and a front or right end portion of the actuating lever 8 to normally urge the front end portion of the actuator lever 8 upwardly. The upward movement of the front end portion of the actuating lever 8 is restricted by a stop 20 mounted on an upper portion of the guide 19. At its rear or left end portion, the actuating lever 8 has a substantially upwardly directed projection 14 that is engageable with an actuator or plunger of the microswitch 13 to actuate the microswitch 13 when the actuating lever 8 is pivotally moved clockwise (FIG. 1) by the action of the foot pedal (not shown) and hence the pull rod 5.

The front end portion of the actuating lever 8 is tapered and has at its lower side a sloping edge 12. A leaf spring 10 is fixed at its rear or left end to a lower level edge 12*a* of the actuating lever 8 and extends in a free form as an extention of the level edge 12*a*, thus defining with the sloping edge 12 a triangular space S. The leaf spring 10 has a yield strength higher than that of the extension spring 9. A safety cover 11 is mounted on a front or right end of the leaf spring 10 perpendicularly thereto.

Figure 4:
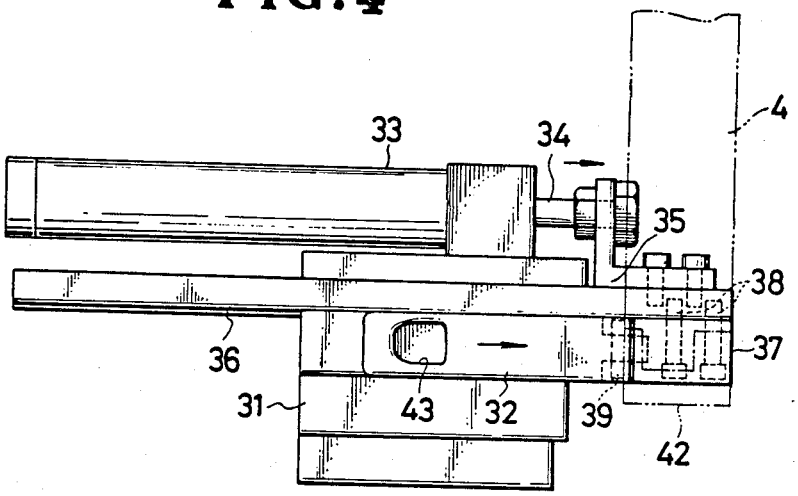
FIG. 4 is a plan view of a lower unit.
Figure 5:
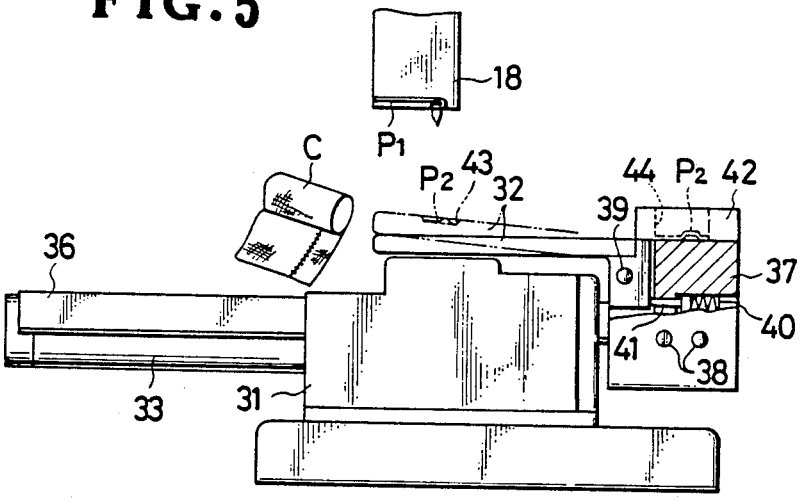
FIG. 5 is a front elevational view, partially in cross section of FIG. 4.
Figure 6:
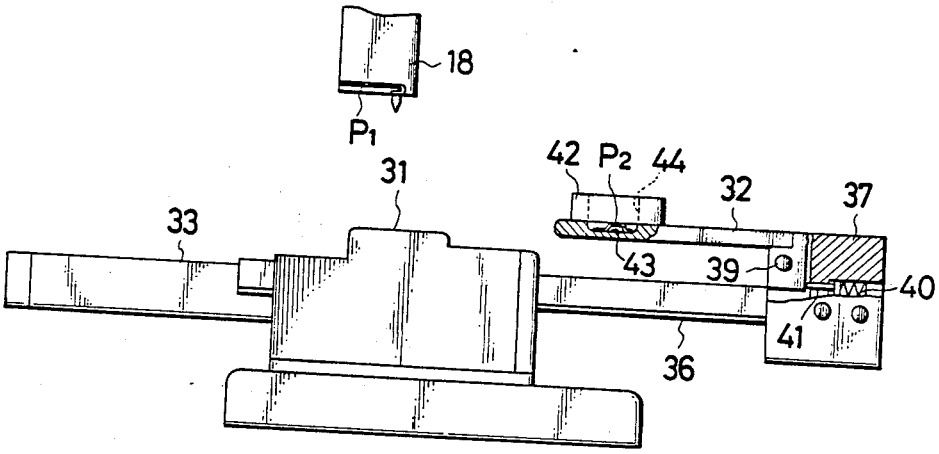
FIG. 6 is a view similar to FIG. 5, showing a die moved to a fastener transfer position.
Figure 7:
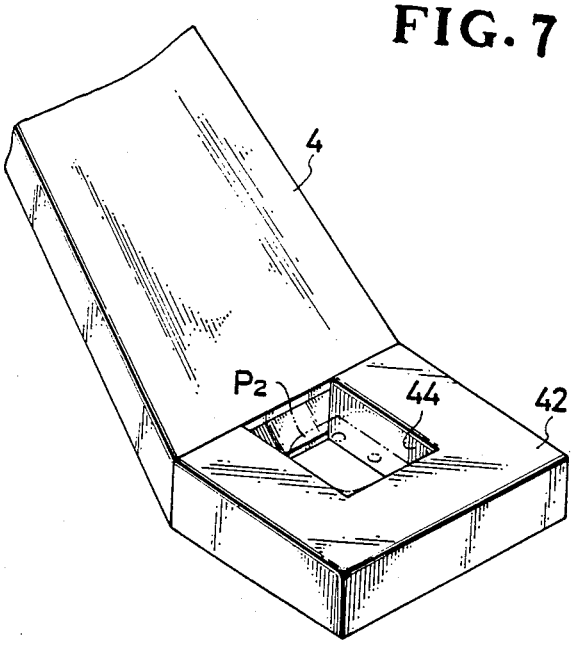
FIG. 7 is an enlarged perspective view of a fastener holding member contiguous to a lower end of a chute.

The lower unit 30 includes a support block 31 fixed to the frame 6, a die 32 slidably supported on the support block 31, a horizontal air cylinder 33 fixed to the support block 31, a guide member 36 fixed to a piston rod 34 of the air cylinder 33 through the medium of a generally L-shaped connector 35, and a die holder 37 fixed to the guide member 36 by a pair of threaded bolts 38, 38 (FIG. 4). The die 32 is pivotally connected to the die holder 37 by a pin 39. A compression spring 40 acts between the die holder 37 and the die 32 so as to normally urge the latter to an inclined position (phantom lines in FIG. 5) in which its distal end is raised to create a gap between the die 32 and the support block 31 so that a tubular portion of the garment C can be threaded onto the die 32 easily. When the piston rod 34 of the air cylinder 33 is extended upon energization of the air cylinder 33, the guide member 36 with the die 32 slides linearly and horizontally on the support block 31 until a fastener supporting seat 43 in the die 32 arrives at a fastener holding member 42, as shown in FIG. 6. As better shown in FIG. 7, the fastener holding member 42 has a generally C-shaped configuration defining a port 44 opening to the lower open end of the second chute 4 for receiving the successive second fastener elements P2 one at a time. As the die 32 arrives at the fastener holding member 42, the die 32 slidingly contacts the undersurface of the fastener holding member 42 and assumes the horizontal position to receive the second fastener element P2 reliably. After a second fastener element P2 is transferred from the fastener holding member 42 to the fastener supporting seat 43, the die 32 is returned to a fastener joining position where the fastener supporting seat 42 with the second fastener element P2 is vertically aligned with the punch 18. Thus the second fastener elements P2 are automatically supplied to the die 32.

The operation of the apparatus will now be described with reference to FIGS. 1 through 6.

In FIG. 1, as the non-illustrated foot pedal is depressed, the pull rod 5 is pulled downwardly to cause the actuating lever 8 to pivot clockwise about the pivot 7 against the spring 9 so that the inclined die 32 is depressed by the lower end of the safety cover 11 as shown in FIGS. 2 and 3, at which time the actuating lever 8 assumes a substantially horizontal posture with the projection 14 spaced from the plunger of the microswitch 13 and also with the triangular space S between the sloping edge 12 and the leaf spring 10. Then a garment fabric C is registered with a register mark M attached to the safety cover 11.

With the garment fabric C thus placed in correct position, as the foot pedal is further depressed to pull the pull rod 5 downwardly from the position of FIGS. 2 and 3, the actuating lever 8 is pivotally moved clockwise from the horizontal position against both the bias of the extension spring 9 and the bias of the leaf spring 10 to reduce the width of the space S as the leaf spring 10 yields upwardly. As a result, the projection 14 at the left end of the actuating lever 8 is raised to depress the plunger of the microswitch 13 to actuate the microswitch 13, energizing the air cylinder 15.

As the ram 17 is lowered upon energization of the air cylinder 15, the punch 18 is moved toward the die 32 to join the first and second fastener elements P1, P2 together in clenched condition with the garment fabric C sandwiched between the two fastener elements.

Upon completion of the assembling of the two fastener elements P1, P2, the punch 18 is returned to its raised position. At that time the air cylinder 33 is energized for extension of the piston rod 34 to move the guide member 36 with the die 32 from the fastener joining position of FIGS. 4 and 5 to the fastener transfer position of FIG. 6 where a succeeding second fastener element P2 received in the port 44 of the fastener holding member 42 is transferred to the fastener supporting seat 43 in the die 32. Then the die 32 with the succeeding second fastener element P2 received in the fastener supporting seat 43 is returned to the original fastener joining position. Thus the successive second fastener elements P2 from the second chute 4 are automatically supplied one at a time to the fastener joining position.

According to the present invention, since the die 32 is reciprocable, in timed relation to the vertical movements of the punch 18, between the fastener joining position and the fastener transfer position, the setting of the individual second fastener element P2 can be performed precisely with maximum efficiency. The die 32 is movable only linearly so that a relatively large space for the operator can be provided.

Further, since there is a gap between the support block 31 and the die 32 as the latter is in the fastener joining position, a tubular portion of the garment C such as trousers can be threaded onto the die 32 with ease.

Although various minor modifications may be suggested by those versed in the art, it should be understood that I wish to embody within the scope of the patent warranted thereon, all such embodiments as reasonably and properly come within the scope of my contribution to the art.

What is claimed is:

1. A machine for automatically assembling a pair of upper and lower fastener elements of a garment fastener with a garment fabric sandwiched between the upper and lower fastener elements, comprising:

(a) a frame;

(b) a pair of first and second chutes for feeding therealong successive upper fastener elements and successive lower fastener elements, respectively;

(c) an upper unit supported by said frame for receiving the successive upper fastener elements one at a time from said first chute, said upper unit including a ram reciprocably supported by said frame and a punch mounted on said ram for vertical movement in response to reciprocating movement of said ram;

(d) a first drive means operatively connected with said ram for reciprocating the latter vertically;

(e) a fastener holding member disposed contiguous to a lower open end of said second chute for temporarily holding the successive lower fastener elements one at a time from said second chute; and (f) a lower unit including (1) a support block fixed to said frame, (2) a horizontal guide member slidably supported on said support block, (3) a second drive means operatively connected with said guide member for reciprocating the latter linearly and horizontally in time relation to the vertical movement of said punch, (4) a die supported by said guide member and movable, in response to the reciprocating movement of said guide member, between a fastener transfer position in which said die is vertically aligned with said fastener holding member to receive the lower fastener element therefrom, and a fastener joining position in which said die is vertically aligned with said punch and is spaced from said support block, and (5) a die holder fixed to one end of said guide member, said die being pivotally mounted on said die holder and movable between an inclined position and a horizontal position.

2. A machine according to claim 1, wherein said die is normally urged to said inclined position by a compression spring acting between said die and said die holder.

3. A machine according to claim 1, wherein when said die is moved to said fastener transfer position, said die is slidingly contactable with an undersurface of said fastener holding member to assume said horizontal position.

4. A machine according to claim 1, wherein said fastener holding member has a generally C-shaped configuration defining a port opening to the lower open end of said second chute.

5. A machine according to claim 4, wherein said die has in its upper surface a fastener supporting seat in the form of a recess which is receptive of the second fastener element and which is vertically aligned with said port of said fastener holding member as said die is disposed in the fastener transfer position.

6. A machine according to claim 1, wherein said second drive means includes an air cylinder having a piston rod connected to said guide member.

* * * * *